US008326164B2

(12) United States Patent
Choi

(10) Patent No.: US 8,326,164 B2
(45) Date of Patent: Dec. 4, 2012

(54) CHARGING VOLTAGE CONTROL METHOD OF IMAGE FORMING APPARATUS USING CONSTANT VOLTAGE CONTROL AND IMAGE FORMING APPARATUS THEREOF

(75) Inventor: Jeong-Jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 634 days.

(21) Appl. No.: 12/494,600

(22) Filed: Jun. 30, 2009

(65) Prior Publication Data

US 2010/0061747 A1 Mar. 11, 2010

(30) Foreign Application Priority Data

Sep. 8, 2008 (KR) ..... 10-2008-0088496

(51) Int. Cl.
*G03G 15/02* (2006.01)

(52) U.S. Cl. ..... 399/50
(58) Field of Classification Search ..... 399/50, 399/176, 48, 174, 168
See application file for complete search history.

(56) References Cited

U.S. PATENT DOCUMENTS

2007/0189787 A1* 8/2007 Hagiwara et al. ..... 399/44
2008/0003004 A1* 1/2008 Miyaji et al. ..... 399/50
2009/0324268 A1* 12/2009 Miyaji et al. ..... 399/50

FOREIGN PATENT DOCUMENTS

JP 2008-46323 2/2008

OTHER PUBLICATIONS

Machine English Translation of JP2008-046323 published on Feb. 28, 2008.*

* cited by examiner

*Primary Examiner* — Walter L Lindsay, Jr.
*Assistant Examiner* — Billy J Lactaoen
(74) *Attorney, Agent, or Firm* — Stanzione & Kim, LLP

(57) ABSTRACT

A charging voltage control method of an image forming apparatus and an image forming apparatus thereof. The charging voltage control method of the image forming apparatus includes: applying a charging voltage amount determined by referring to a basic lookup table which determines the charging voltage based on a system load; and correcting the applied charging voltage by using a first correction value which is determined based on a first correction lookup table which determines the first correction value based on a difference between a target current corresponding to the lifespan of the charging roller and a charging current.

22 Claims, 9 Drawing Sheets

CHARGING VOLTAGE CONTROL METHOD OF IMAGE FORMING APPARATUS USING CONSTANT VOLTAGE CONTROL AND IMAGE FORMING APPARATUS THEREOF

CROSS-REFERENCE TO RELATED APPLICATIONS

This application claims priority under 35 U.S.C. §119(a) from Korean Patent Application No. 10-2008-0088496, filed on Sep. 8, 2008 in the Korean Intellectual Property Office, the disclosure of which is incorporated herein by reference in its entirety.

BACKGROUND

1. Field of the Invention

The present general inventive concept relates to a charging voltage control method of an image forming apparatus using a constant voltage control, and an image forming apparatus thereof, and more particularly, to a charging voltage control method of an image forming apparatus using a constant voltage control to control a charging voltage applied to a charging roller to maintain a surface electric potential of an organic photosensitive body, and an image forming apparatus thereof.

2. Description of the Related Art

An image forming apparatus of a contact charging type, such as a laser printer, a laser multifunction device, etc., applies a charging voltage to a charging roller so that an electric potential of a predetermined level can be formed on a surface of an organic photosensitive body as an image carrying body.

To guarantee a printing quality, it is generally necessary to uniformly maintain the surface electric potential of the organic photosensitive body as long as there is no change to an applied charging voltage. However, it is possible that the surface electric potential of the organic photosensitive body will vary depending on various other causes.

Accordingly, as a method for uniformly maintaining the surface electric potential of the organic photosensitive body, there is a method of applying a charging voltage at a predetermined reference level to the organic photosensitive body and the charging roller to recognize a system load, and controlling the applied charging voltage based on the recognition result of the system load.

However, in this charging voltage control method, a previously provided lookup table is used. In this case, the lookup table is incapable of being perfectly provided to correspond to all practical circumstances and conditions that lead to a variation of the surface electric potential of the organic photosensitive body. Accordingly, in controlling the charging voltage by using the lookup table, it is necessary to improve reliability of a control result with a consideration of more various practical circumstances and conditions.

SUMMARY

The present general inventive concept provides a charging voltage control method of an image forming apparatus to correct a charging voltage by taking into consideration a resistance variation of a charging roller depending on a lifespan thereof to further improve reliability in controlling the charging voltage by using a lookup table, and an image forming apparatus thereof.

Additional features and utilities of the present general inventive concept will be set forth in part in the description which follows and, in part, will be obvious from the description, or may be learned by practice of the general inventive concept.

Embodiments of the present general inventive concept can be achieved by providing a charging voltage control method of an image forming apparatus, including: applying a charging voltage amount determined by referring to a basic lookup table which determines the charging voltage based on a system load, and correcting the applied charging voltage by using a first correction value which is determined based on a first correction lookup table which determines the first correction value using on a difference between a target current corresponding to the lifespan of the charging roller and a charging current.

The correcting may be performed for each page when printing a plurality of pages.

The method may further include additionally correcting the applied charging voltage by using a second correction value which is determined based on a second correction lookup table.

The additionally correcting operation may be performed if a charging current of a present page of the plurality of pages is smaller than a charging current of a prior page.

In the additionally correcting operation, the charging voltage of a present page may be smaller than the charging voltage of a prior voltage.

At least one of the first correction value and the second correction value may be restricted to be less than or equal to a predetermined limit value.

At least one of the first correction value and the second correction value may be provided to correspond to temperature and/or humidity.

Embodiments of the present general inventive concept can also be achieved by providing an image forming apparatus, including an image carrying body on which a latent image is formed, a charging roller which charges a surface of the image carrying body to form the latent image, a voltage supplying unit which applies a charging voltage to charge the surface of the image carrying body to the charging roller, and a control unit which controls the voltage supplying unit to apply the charging voltage of an amount determined by referring to a basic lookup table which determines the charging voltage based on a system load, and to correct the applied charging voltage by using a first correction value which is determined based on a first correction lookup table which determines the first correction value using a difference between a target current corresponding to a lifespan of the charging roller and a charging current.

The control unit may correct the applied charging voltage for each page when printing a plurality of pages.

The control unit may control the voltage supplying unit to additionally correct the applied charging voltage by using a second correction value which is determined based on a second correction lookup table.

The control unit may additionally correct the applied charging voltage if the charging current of a present page of the plurality of pages is smaller than the charging current of a prior page.

The charging voltage of a present page may be smaller than the charging voltage of a prior voltage.

The first correction value and/or the second correction value may be restricted to be less than or equal to a predetermined limit value.

The first correction value and/or the second correction value may be provided to correspond to at least one of temperature and humidity.

Embodiments of the present general inventive concept can also be achieved by providing a method of controlling a charging voltage of a charging roller of an image forming apparatus, the method including applying a charging voltage to the charging roller corresponding to a system load and an operating environment, generating a corrected charging voltage using the applied charging voltage and a correction value from at least one correction lookup table and a second correction table, the correction value corresponding to the applied charging voltage, and applying the corrected charging voltage to the charging roller.

The generating of a corrected charging voltage may include detecting a charging current based on the charging voltage, obtaining a first value from a first correction lookup table based on the detected charging current, obtaining a second value from a second correction lookup table based on the detected charging current, and increasing the applied charging voltage by the correction value which is a sum of the first correction value and the second correction value.

The obtaining a first value may include calculating a difference between a target current and the detected charging current, where the target current is based on a remaining lifespan of the charging roller, and selecting a value of the first correction lookup table corresponding to the calculated difference and the operating environment.

The operating environment may be selected from the group consisting of high temperature/high humidity, high temperature/normal humidity, high temperature/low humidity, normal temperature/high humidity, normal temperature/normal humidity, normal temperature/low humidity, low temperature/high humidity, low temperature/normal humidity, and low temperature/low humidity.

The obtaining a second value may include calculating a difference between a charging current of a prior page with a charging current of a previous page, and selecting a value of the second correction lookup table corresponding to the calculated difference and the operating environment.

Embodiments of the present general inventive concept can also be achieved by providing an image forming apparatus including a photosensitive medium on which to form an image, the image forming apparatus including a charging roller to charge a surface of the photosensitive medium, a voltage supplying unit to apply a charging voltage to the charging roller corresponding to a system load and an operating environment, and a control unit to generate a corrected charging voltage using the applied charging current and a correction value from at least one correction lookup table that corresponds to the applied charging voltage, and to control the voltage supplying unit to apply the corrected charging voltage to the charging roller.

The image forming apparatus may further include a current detector to detect a current of the charging voltage and to transmit the detected current to the control unit, wherein the control unit generates the corrected charging voltage based on the detected current of the charging voltage.

The at least one correction table may include a first correction table which includes a plurality of correction values based on a difference between a target current corresponding to a lifespan of the charging roller and a charging current based on the applied charging voltage, and a second correction table which includes a plurality of correction values based on a difference between a charging current corresponding to a prior image and a charging current corresponding to a present image.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings, of which

DETAILED DESCRIPTION OF EXEMPLARY EMBODIMENTS

Figure 1:
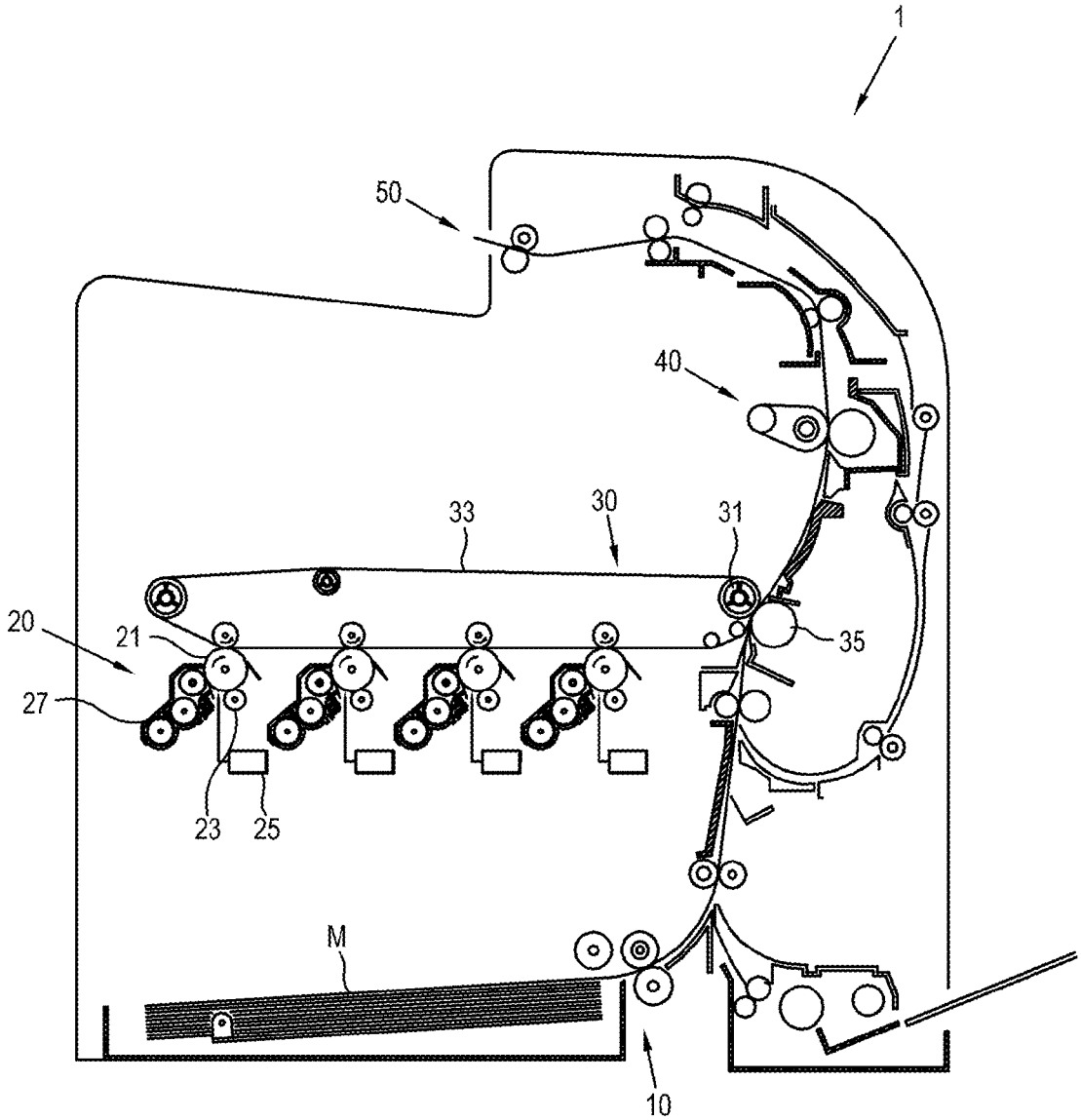
FIG. 1 is a sectional view illustrating a schematic configuration of an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different exemplary embodiments may be omitted for the convenience of clarity.

FIG. 1 is a sectional view illustrating a schematic configuration of an image forming apparatus according to an exemplary embodiment of the present general inventive concept. As illustrated in FIG. 1, an image forming apparatus 1 according to an exemplary embodiment of the present general inventive concept forms an image by an electrophotographic process, and may be implemented as a laser printer, a laser multifunction device, etc.

Referring to FIG. 1, the image forming apparatus 1 includes a medium supplying unit 10 to supply printing media M, an image forming unit 20 to form images, a transferring unit 30 to transfer the formed images to the printing media M, a fusing unit 40 to fuse the images transferred to the printing media M, and a discharging unit 50 to discharge the printing media M. This configuration of the present exemplary embodiment is just an example according to the present general inventive concept, and alternatively, the image forming unit 20, the transferring unit 30 and the fusing unit 40 may be implemented as a single image forming unit in a broad sense, or in other alternative configurations.

The image forming unit 20 includes an organic photosensitive body (or organic photoconductor or organic photoreceptor) 21, a charging roller 23 to charge the organic photosensitive body 21 to have a predetermined electric potential, an exposing unit 25 to form a latent image on the organic photosensitive body 21, and a developing unit 27 to develop a visible image corresponding to the latent image formed on the organic photosensitive body 21. The organic photosensitive body 21 is an example of an image carrying body according to the present general inventive concept.

As illustrated in FIG. 1, the image forming unit 20 may be configured with four sub image forming units corresponding to each color, for example, cyan C, magenta M, yellow Y and black K. The configuration of the image forming unit 20 as illustrated in FIG. 1 is for exemplary purposes, and alternatively, the image forming unit according to the present general inventive concept may include any number of sub image forming units, an image forming unit (not illustrated) to form a monochrome image, etc.

The transferring unit 30 includes a driving roller 31, a transferring belt 33 to be rotated by the driving roller 31, and a transferring roller 35 disposed to face the driving roller 31 to interpose the transferring belt 33 between the driving roller 31 and the transferring roller 35.

The visible image formed on the organic photosensitive body 21 is transferred to the transferring belt 33, and then the image transferred to the transferring belt 33 is transferred to a printing medium M supplied from the medium supplying unit 10. A predetermined bias voltage is applied to the transferring roller 35, and a portion of the printing medium M is charged by the applied bias voltage. The image transferred to the transferring belt 33 is transferred to the printing medium M by electrostatic attraction. The image transferred to the printing medium M is fused to the printing medium M by heat and pressure applied by the fusing unit 40.

Figure 2:
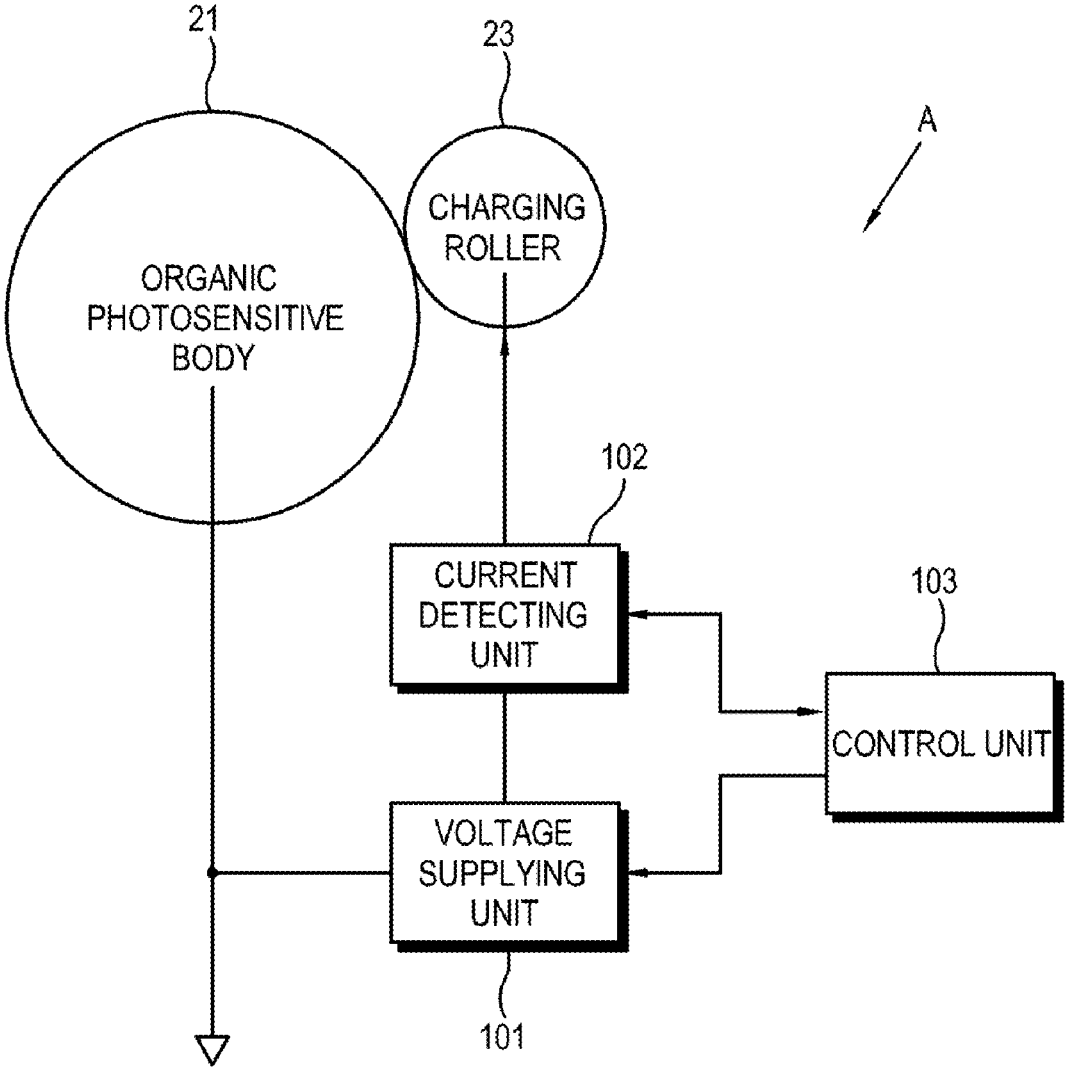
FIG. 2 illustrates a configuration to control a charging voltage of an image forming apparatus according to an exemplary embodiment of the present general inventive concept.

FIG. 2 illustrates a configuration A to control a charging voltage of the image forming apparatus 1 according to an exemplary embodiment of the present general inventive concept. The image forming apparatus 1 may include a voltage supplying unit 101, a current detecting unit 102 and a control unit 103, in addition to the organic photosensitive body 21 and the charging roller 23.

The voltage supplying unit 101 supplies a charging voltage to the charging roller 23 so that a surface electric potential of a predetermined level can be formed at the organic photosensitive body 21. The voltage supplying unit 101 may be implemented as a high voltage power supply (HVPS), and for example, the applied charging voltage may be approximately −1200V if the surface electric potential of the organic photosensitive body 21 is approximately −600V.

The current detecting unit 102 detects a charging current flowing through the organic photosensitive body 21 and the charging roller 23. The charging current detected by the current detecting unit 102 is transmitted to the control unit 103. The current detecting unit 102 may be implemented as a resistor connected to the charging roller 23 in series, and the charging current may be estimated based on a voltage across the resistor.

The control unit 103 determines a correction value necessary to correct the charging voltage supplied from the voltage supplying unit 101 based on the detecting result of the charging current transmitted from the current detecting unit 102, and controls the voltage supplying unit 101 so that the charging voltage can be corrected to correspond to the determined correction value. That is, the control unit 103 performs a constant voltage control to determine the correction value of the applied charging voltage based on the estimated charging current, and controls the voltage supplying unit 101 to constantly adjust the changing voltage based on the changing determined correction values.

The control unit 103, according to an exemplary embodiment of the present general inventive concept, performs the following processes to control the charging voltage:

determining the charging voltage based on a system load;

correcting the charging voltage based on a resistance variation of the charging roller depending on a lifespan (first correction); and correcting the charging voltage based on a resistance variation of the charging roller depending on variation of the charging voltage (second correction).

Hereinafter, each process will be described in detail.

The surface electric potential of the organic photosensitive body 21 may be changed due to various causes. In the present exemplary embodiment, a system load is taken into consideration as one of the potential causes of a change in the surface electric potential of the organic photosensitive body 21. For example, since the organic photosensitive body 21 contacts the charging roller 23, the surface thereof may be worn away by repeatedly performing image forming operations, and in this case, a layer thickness of the surface of the organic photosensitive body 21 decreases as time elapses. The layer thickness decrease of the surface of the organic photosensitive body 21 causes a decrease of a load resistance of the organic photosensitive body 21 so that the charging current increases, and accordingly, the surface electric potential of the organic photosensitive body 21 may increase as well. However, the causes of such a variation of the system load may vary, and as such are not limited thereto.

In an exemplary embodiment of the present general inventive concept, there is provided a lookup table (hereinafter, referred to as 'basic lookup table') to observe and analyze a degree of variation of the surface electric potential of the organic photosensitive body 21 due to the variation of the system load through an experiment, and to allow the charging voltage to be applied to be determined from the result.

The experiment according to the present exemplary embodiment is performed with respect to a new organic photosensitive body 21 and a charging roller 23 that have not been used as the time of the experiment, and the experiment is repeated until the lifespan of the organic photosensitive body 21 and the charging roller 23 are expired. Also, the experiment is performed for each of the following environments, including a normal temperature/normal humidity (hereinafter, referred to as 'NN'), a low temperature/low humidity (hereinafter, referred to as 'LL'), and a high temperature/high humidity (hereinafter, referred to as 'HH').

In the experiment according to the present exemplary embodiment, the surface electric potential of the organic photosensitive body 21 is measured, the charging voltage is confirmed if the measured surface electric potential reaches a predetermined target electric potential, and the charging current flowing is measured when the measured surface electric potential reaches a predetermined target electric potential. The target electric potential in the experiment according to the present exemplary embodiment is determined according to each environment. For example, if the target electric potential of the NN environment is −600V in a normal environment, the target electric potential of the LL environment is −630V, and the target electric potential of the HH environment is −575V.

Figure 3:
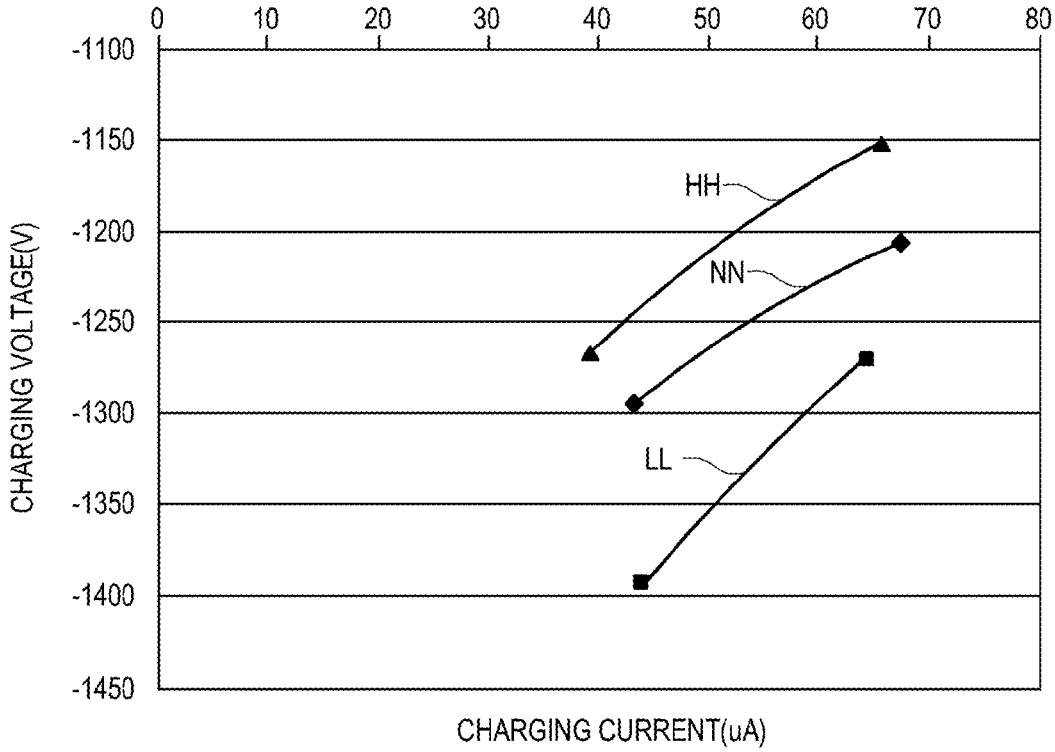
FIG. 3 is a graph illustrating a relationship between a charging current and a charging voltage according to an exemplary embodiment of the present general inventive concept.

FIG. 3 is a graph illustrating a relationship between the charging current and the charging voltage obtained by the experiment result according to an exemplary embodiment of the present general inventive concept. In an exemplary embodiment of the present general inventive concept, the following equations expressing a relationship between the charging current and the charging voltage are based on the graph as illustrated in FIG. 3.

$$Y=175.66\times Ln(X)-1931 \text{(in case of } NN) \quad \text{Equation 1}$$

$$Y=280.45\times Ln(X)-2369 \text{(in case of } LL) \quad \text{Equation 2}$$

$$Y=172.13\times Ln(X)-1888 \text{(in case of } HH) \quad \text{Equation 3}$$

In the Equations 1 to 3, X and Y respectively represent the charging current and the charging voltage.

The basic lookup table provided based on the results of the Equations 1 to 3 is illustrated as the following Table 1.

TABLE 1

| system load | charging current | ADC voltage | ADC value | charging voltage (NN) | charging voltage (LL) | charging voltage (HH) |
|---|---|---|---|---|---|---|
| 18.25 MΩ | 65.8 μA | 1.1495 V | 357 | −1196 | −1195 | −1168 |
| 18.50 MΩ | 64.9 μA | 1.1400 V | 354 | −1198 | −1199 | −1170 |
| 18.75 MΩ | 64.0 μA | 1.1305 V | 351 | −1201 | −1203 | −1172 |
| 19.00 MΩ | 63.2 μA | 1.1210 V | 348 | −1203 | −1206 | −1175 |
| 19.25 MΩ | 62.3 μA | 1.1125 V | 345 | −1205 | −1210 | −1177 |
| 19.50 MΩ | 61.5 μA | 1.1040 V | 343 | −1208 | −1214 | −1179 |
| 19.75 MΩ | 60.8 μA | 1.0950 V | 340 | −1210 | −1217 | −1181 |
| 20.00 MΩ | 60.0 μA | 1.0860 V | 337 | −1212 | −1221 | −1183 |
| 20.25 MΩ | 59.3 μA | 1.0785 V | 335 | −1214 | −1224 | −1186 |
| 20.50 MΩ | 58.5 μA | 1.0710 V | 332 | −1217 | −1228 | −1188 |
| 20.75 MΩ | 57.8 μA | 1.0630 V | 330 | −1219 | −1231 | −1190 |
| 21.00 MΩ | 57.1 μA | 1.0550 V | 327 | −1221 | −1234 | −1192 |
| 21.25 MΩ | 56.5 μA | 1.0480 V | 325 | −1223 | −1238 | −1194 |
| 21.50 MΩ | 55.8 μA | 1.0410 V | 323 | −1225 | −1241 | −1196 |
| 21.75 MΩ | 55.5 μA | 1.0340 V | 321 | −1227 | −1244 | −1198 |
| 22.00 MΩ | 54.5 μA | 1.0270 V | 319 | −1229 | −1247 | −1200 |
| 22.25 MΩ | 53.9 μA | 1.0205 V | 317 | −1231 | −1251 | −1202 |
| 22.50 MΩ | 53.3 μA | 1.0140 V | 315 | −1233 | −1254 | −1204 |
| 22.75 MΩ | 52.7 μA | 1.0075 V | 313 | −1235 | −1257 | −1206 |
| 23.00 MΩ | 52.2 μA | 1.0010 V | 311 | −1237 | −1260 | −1207 |
| 23.25 MΩ | 51.6 μA | 0.9955 V | 309 | −1239 | −1263 | −1209 |
| 23.50 MΩ | 51.1 μA | 0.9900 V | 307 | −1241 | −1266 | −1211 |
| 23.75 MΩ | 50.5 μA | 0.9840 V | 305 | −1242 | −1269 | −1213 |
| 24.00 MΩ | 50.0 μA | 0.9780 V | 303 | −1244 | −1272 | −1215 |
| 24.25 MΩ | 49.5 μA | 0.9725 V | 302 | −1246 | −1275 | −1217 |
| 24.50 MΩ | 49.0 μA | 0.9670 V | 300 | −1248 | −1278 | −1218 |
| 24.75 MΩ | 48.5 μA | 0.9615 V | 298 | −1250 | −1281 | −1220 |
| 25.00 MΩ | 48.0 μA | 0.9560 V | 297 | −1251 | −1283 | −1222 |
| 25.25 MΩ | 47.5 μA | 0.9510 V | 295 | −1253 | −1286 | −1224 |
| 25.50 MΩ | 47.1 μA | 0.9460 V | 294 | −1255 | −1289 | −1225 |
| 25.75 MΩ | 46.6 μA | 0.9410 V | 292 | −1257 | −1292 | −1227 |
| 26.00 MΩ | 46.2 μA | 0.9360 V | 290 | −1258 | −1294 | −1229 |
| 26.25 MΩ | 45.7 μA | 0.9315 V | 289 | −1260 | −1297 | −1230 |
| 26.50 MΩ | 45.3 μA | 0.9270 V | 288 | −1262 | −1300 | −1232 |
| 26.75 MΩ | 44.9 μA | 0.9225 V | 286 | −1263 | −1302 | −1233 |
| 27.00 MΩ | 44.4 μA | 0.9180 V | 285 | −1265 | −1305 | −1235 |
| 27.25 MΩ | 44.0 μA | 0.9140 V | 284 | −1267 | −1307 | −1237 |
| 27.50 MΩ | 43.6 μA | 0.9100 V | 282 | −1268 | −1310 | −1238 |
| 27.75 MΩ | 43.2 μA | 0.9055 V | 281 | −1270 | −1313 | −1240 |
| 28.00 MΩ | 42.9 μA | 0.9010 V | 280 | −1271 | −1315 | −1241 |
| 28.25 MΩ | 42.5 μA | 0.8970 V | 278 | −1273 | −1318 | −1243 |
| 28.50 MΩ | 42.1 μA | 0.8930 V | 277 | −1274 | −1320 | −1244 |
| 28.75 MΩ | 41.7 μA | 0.8890 V | 276 | −1276 | −1323 | −1246 |
| 29.00 MΩ | 41.4 μA | 0.8850 V | 275 | −1277 | −1325 | −1247 |
| 29.25 MΩ | 41.0 μA | 0.8815 V | 274 | −1279 | −1327 | −1249 |
| 29.50 MΩ | 40.7 μA | 0.8780 V | 272 | −1280 | −1330 | −1250 |
| 29.75 MΩ | 40.3 μA | 0.8740 V | 271 | −1282 | −1332 | −1252 |
| 30.00 MΩ | 40.0 μA | 0.8700 V | 270 | −1283 | −1334 | −1253 |
| 30.25 MΩ | 39.7 μA | 0.8665 V | 269 | −1285 | −1337 | −1255 |
| 30.50 MΩ | 39.3 μA | 0.8630 V | 268 | −1286 | −1339 | −1256 |

In Table 1, the 'ADC value' represents an analog-digital converging value measured by using the current detecting unit 102 for detecting the charging current, and the 'ADC voltage' represents a voltage corresponding to the 'ADC value'. The 'system load' represents a system load value estimated in each case.

Figure 4:
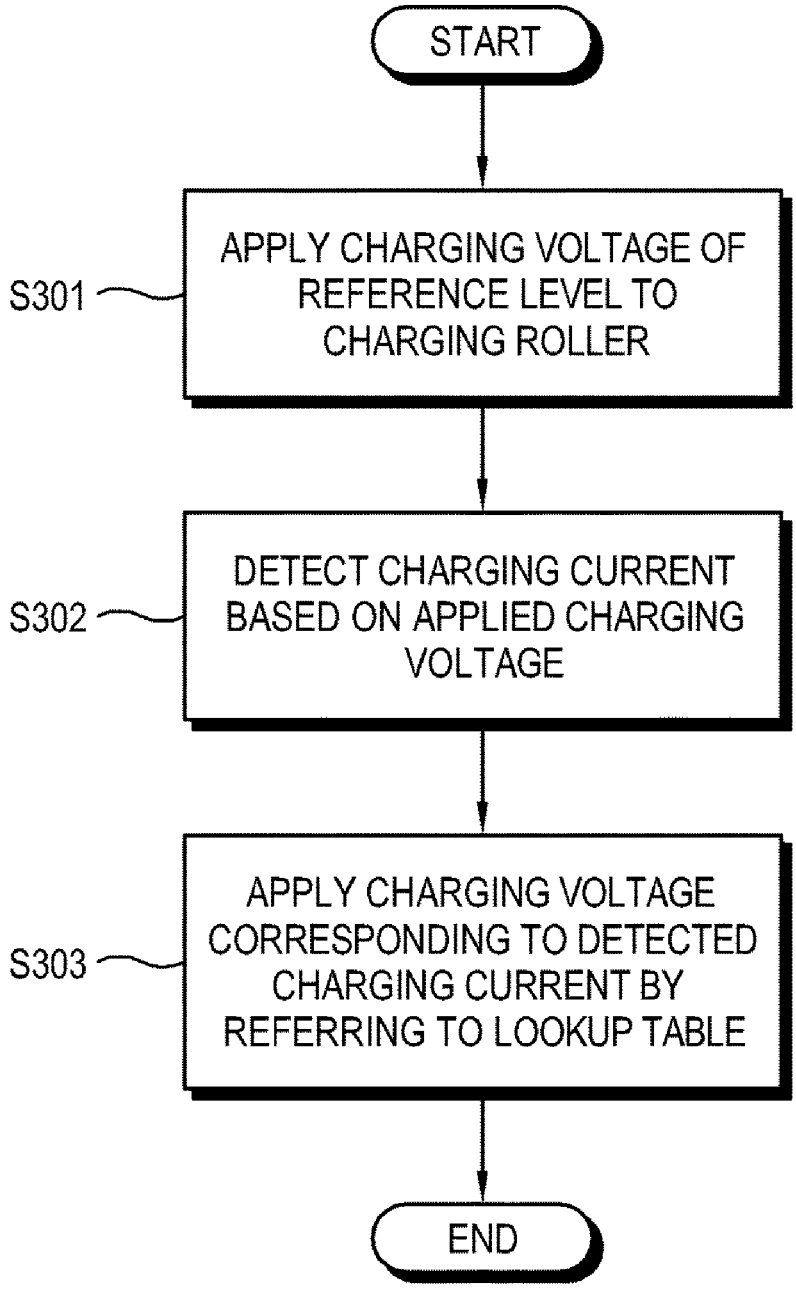
FIG. 4 illustrates a charging voltage determining process based on a system load according to an exemplary embodiment of the present general inventive concept.

FIG. 4 illustrates a charging voltage determining process according to an exemplary embodiment of the present general inventive concept. The control unit 103 controls the voltage supplying unit 101 to apply the charging voltage of a predetermined reference level to the charging roller 23 (operation s301). The reference level in the present exemplary embodiment may be −1200V. Then, the control unit 103 controls the current detecting unit 102 to detect the charging current based on the applied charging voltage (operation S302). Then, the control unit 103 receives the detected charging current from the current detecting unit 102, and determines the charging voltage to be applied to correspond to the detected charging current by referring to a basic lookup table, for example, Table 1, and controls the voltage supplying unit 101 to apply the determined charging voltage (operation S303). For example, referring to Table 1, if the measured ADC value is 290, the estimated charging current is 46.2 μA, and accordingly, the charging voltage to be applied to obtain the target electric potential (for example, for an NN environment) may be determined to be −1258V.

The charging roller 23 may be formed of a material such as a rubber, etc., and chains between carbon atoms of the roller unit may be broken by weakening intermolecular coherence due to aging if this material is used for a long time.

Figure 6:
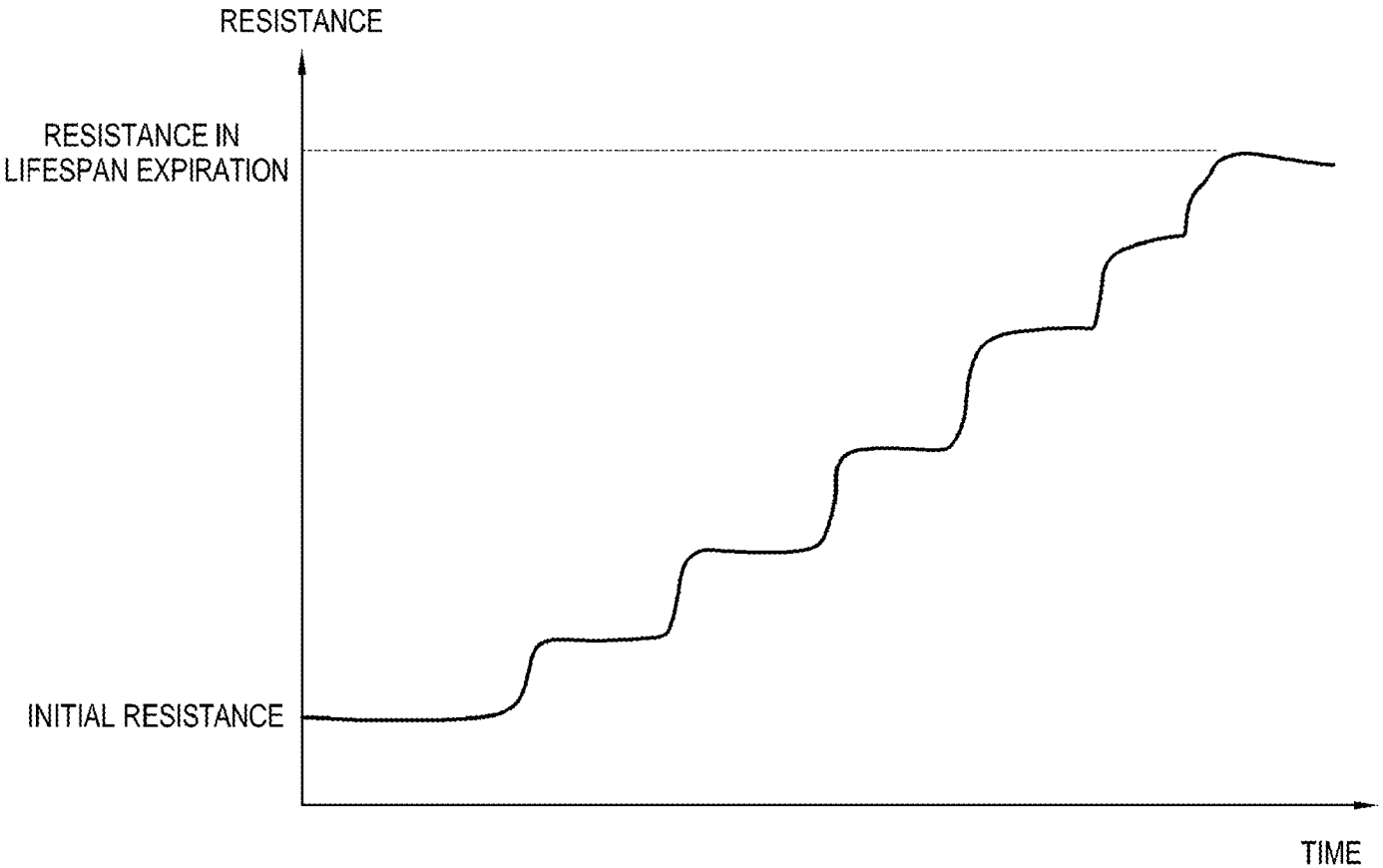
FIG. 6 illustrates a resistance variation of a charging roller depending on the lifespan according to an exemplary embodiment of the present general inventive concept.

Accordingly, a load resistance of the charging roller 23 may increase as time elapses, and the surface electric potential of the organic photosensitive body 21 may decrease. FIG. 6 illustrates a resistance variation of the charging roller 23 depending on the lifespan of the charging roller 23 according to an exemplary embodiment of the present general inventive concept. As illustrated in FIG. 6, the resistance of the charging roller 23 gradually increases from an initial resistance value (initial resistance) to a resistance value when the lifespan is expired (resistance in lifespan expiration) as time elapses.

In the present exemplary embodiment, the charging voltage is corrected based on the resistance variation of the charging roller 23 depending on its lifespan in addition to the process to determine the charging voltage to be applied to the charging roller 23 by using the basic lookup table, based on the system load, thereby improving reliability of the charging voltage control.

Figure 5:
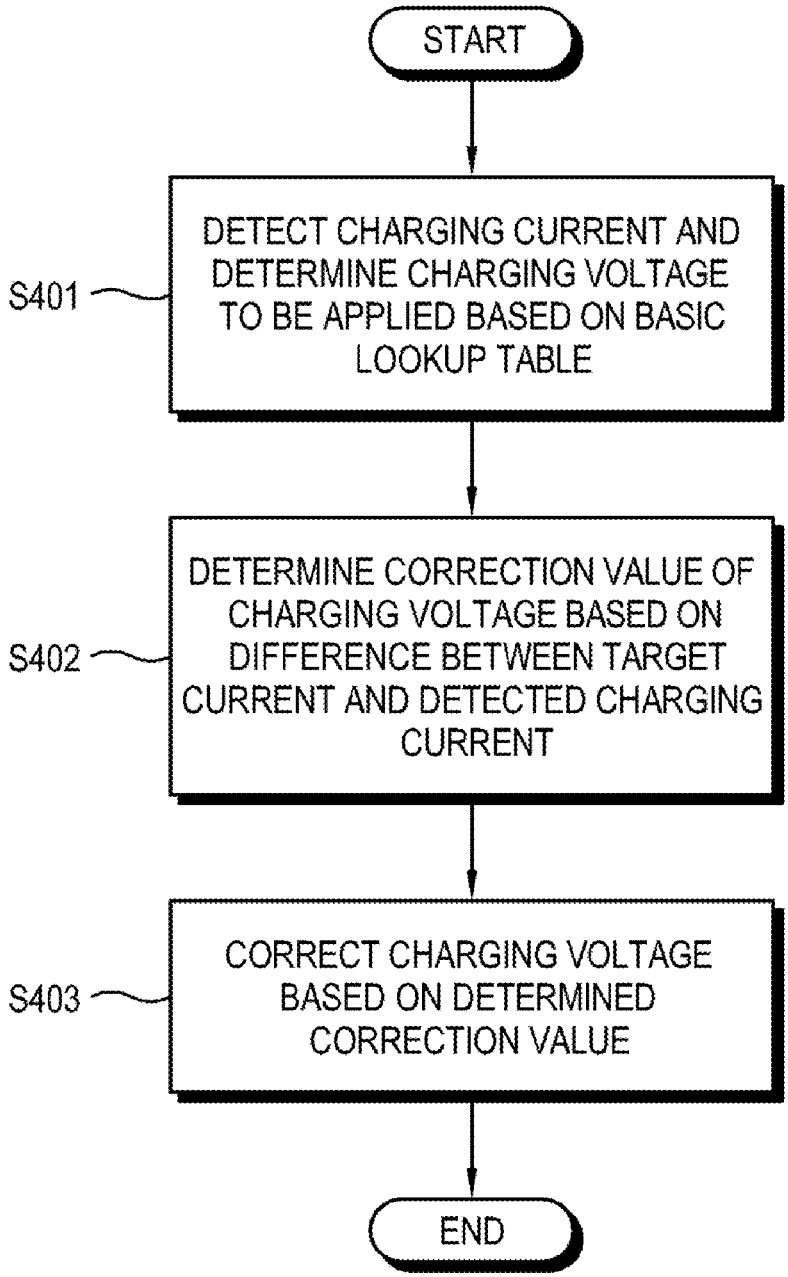
FIG. 5 illustrates a correcting process of a charging voltage with a consideration of a resistance variation of a charging roller depending on a lifespan according to an exemplary embodiment of the present general inventive concept.

FIG. 5 illustrates a correcting process (hereinafter, referred to as 'first correction') of the charging voltage based on a resistance variation of the charging roller 23 depending on its lifespan according to an exemplary embodiment of the present general inventive concept. The control unit 103 obtains the detected charging current from the current detecting unit 102, and determines the charging voltage to be applied by referring to the basic lookup table (operation S401).

Then, the control unit 103 determines a correction value of the charging voltage to be applied based on a difference between the charging current (hereinafter, also referred to as 'target current') corresponding to the surface electric potential (hereinafter also referred to as 'target electric potential') of the organic photosensitive body 21 as a target, and the charging current detected in operation S401 (operation S402).

The target current of the organic photosensitive body 21 is previously determined based on the variation of the system load depending on the lifespan of the charging roller 23. Table 2 represents a lookup table (hereinafter, referred to as 'target current lookup table') that contains information about the target current of the organic photosensitive body 21 according to an exemplary embodiment of the present general inventive concept.

TABLE 2

| number of printed printing media | | | | target current (target ADC) | | |
|---|---|---|---|---|---|---|
| Kpage unit | | page unit | | NN and NH | LN 1, 2, 3 and LL | HH1 and HH2 |
| 0.0K | 2.0K | 0 | 2,000 | 284 | 291 | 263 |
| 2.0K | 4.0K | 2,001 | 4,000 | 285 | 292 | 264 |
| 4.0K | 6.0K | 4,001 | 6,000 | 285 | 293 | 264 |
| 6.0K | 8.0K | 6,001 | 8,000 | 286 | 294 | 265 |
| 8.0K | 10.0K | 8,001 | 10,000 | 286 | 295 | 265 |
| 10.0K | 12.0K | 10,001 | 12,000 | 287 | 296 | 266 |
| 12.0K | 14.0K | 12,001 | 14,000 | 287 | 297 | 267 |
| 14.0K | 16.0K | 14,001 | 16,000 | 288 | 298 | 267 |
| 16.0K | 18.0K | 16,001 | 18,000 | 288 | 299 | 268 |
| 18.0K | 20.0K | 18,001 | 20,000 | 288 | 300 | 268 |
| 20.0K | 22.0K | 20,001 | 22,000 | 288 | 301 | 268 |
| 22.0K | 24.0K | 22,001 | 24,000 | 289 | 302 | 268 |
| 24.0K | 26.0K | 24,001 | 26,000 | 290 | 303 | 269 |
| 26.0K | 28.0K | 26,001 | 28,000 | 290 | 304 | 270 |
| 28.0K | 30.0K | 28,001 | 30,000 | 291 | 305 | 270 |
| 30.0K | 32.0K | 30,001 | 32,000 | 291 | 306 | 270 |
| 32.0K | 34.0K | 32,001 | 34,000 | 292 | 307 | 271 |
| 34.0K | 36.0K | 34,001 | 36,000 | 292 | 308 | 272 |
| 36.0K | 38.0K | 36,001 | 38,000 | 293 | 309 | 272 |
| 38.0K | 40.0K | 38,001 | 40,000 | 294 | 310 | 273 |
| 40.0K | 42.0K | 40,001 | 42,000 | 294 | 311 | 273 |
| 42.0K | 44.0K | 42,001 | 44,000 | 294 | 312 | 273 |
| 44.0K | 46.0K | 44,001 | 46,000 | 294 | 313 | 273 |
| 46.0K | 48.0K | 46,001 | 48,000 | 295 | 314 | 274 |
| 48.0K | 50.0K | 48,001 | 50,000 | 295 | 315 | 275 |
| 50.0K | 52.0K | 50,001 | 52,000 | 296 | 316 | 275 |
| 52.0K | 54.0K | 52,001 | 54,000 | 297 | 317 | 276 |
| 54.0K | 56.0K | 54,001 | 56,000 | 297 | 318 | 276 |
| 56.0K | 58.0K | 56,001 | 58,000 | 298 | 319 | 277 |
| 58.0K | 60.0K | 58,001 | 60,000 | 298 | 320 | 277 |
| 60.0K | 62.0K | 60,001 | 62,000 | 299 | 321 | 278 |
| 62.0K | 64.0K | 62,001 | 64,000 | 299 | 322 | 278 |
| 64.0K | 66.0K | 64,001 | 66,000 | 299 | 323 | 278 |
| 66.0K | 68.0K | 66,001 | 68,000 | 300 | 324 | 279 |
| 68.0K | 70.0K | 68,001 | 70,000 | 300 | 325 | 279 |
| 70.0K | 72.0K | 70,001 | 72,000 | 300 | 326 | 280 |
| 72.0K | 74.0K | 72,001 | 74,000 | 301 | 327 | 280 |
| 74.0K | 76.0K | 74,001 | 76,000 | 302 | 328 | 281 |
| 76.0K | 78.0K | 76,001 | 78,000 | 302 | 329 | 282 |
| 78.0K | 80.0K | 78,001 | 80,000 | 303 | 331 | 282 |
| 80.0K | 82.0K | 80,001 | 82,000 | 303 | 331 | 282 |
| 82.0K | 84.0K | 82,001 | 84,000 | 304 | 332 | 283 |
| 84.0K | 86.0K | 84,001 | 86,000 | 304 | 333 | 283 |
| 86.0K | 88.0K | 86,001 | 88,000 | 304 | 334 | 283 |
| 88.0K | 90.0K | 88,001 | 90,000 | 305 | 336 | 284 |
| 90.0K | 92.0K | 90,001 | 92,000 | 305 | 336 | 284 |
| 92.0K | 94.0K | 92,001 | 94,000 | 306 | 337 | 285 |
| 94.0K | 96.0K | 94,001 | 96,000 | 306 | 338 | 285 |
| 96.0K | 98.0K | 96,001 | 98,000 | 307 | 339 | 286 |
| 98.0K | 100.0K | 98,001 | max | 307 | 341 | 287 |

In Table 2, the 'target ADC' represents an analog-digital converging value of the target current of the organic photosensitive body 21, and the 'number of printed printing media' represents the number of printing media M that have been printed by the image forming apparatus 1. Also, NH represents a normal temperature/high humidity environment, and LN 1, 2 and 3 represent a low temperature/normal humidity environment. As illustrated in Table 2, as the lifespan of the charging roller 23 approaches expiration, that is, as the number of printed printing media increases, the target current (target ADC) of the organic photosensitive body 21 increases as well. This means that the system load decreases depending on the lifespan of the charging roller 23.

Figure 7:
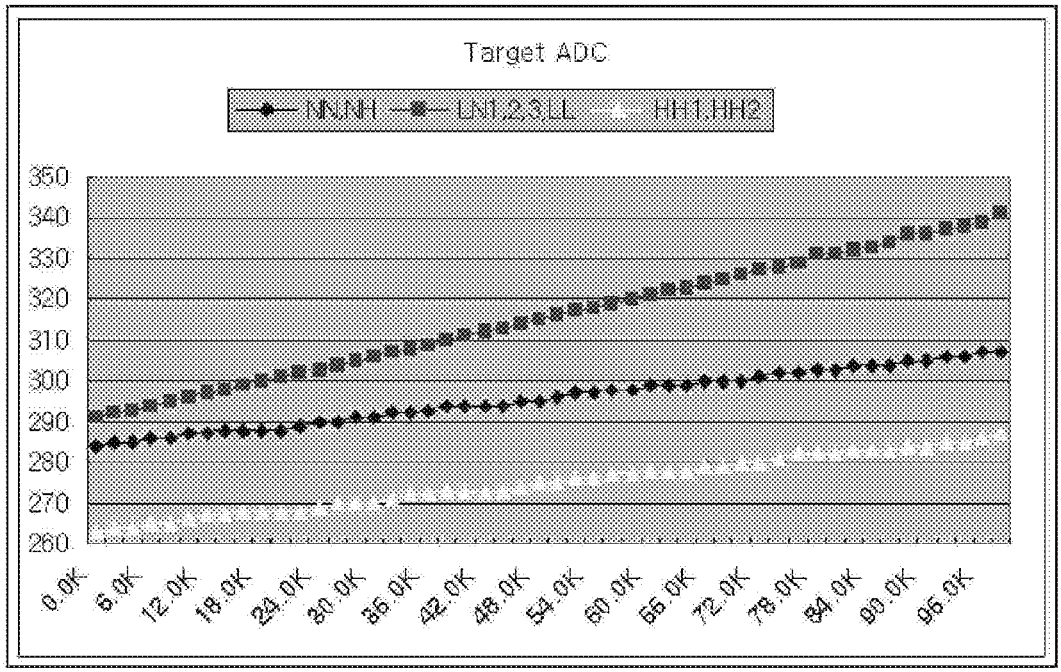
FIG. 7 is a graph illustrating a target current according to an exemplary embodiment of the present general inventive concept.

FIG. 7 is a graph illustrating the target current (target ADC) of Table 2. In FIG. 7, the horizontal axis represents the number of printing media that have been printed, and the vertical axis represents the target current (target ADC).

The target current in the operation S402 may be determined based on the number of printing media M printed by the image forming apparatus 1.

In operation S402, in determining the correction value of the charging current to be applied, a lookup table (hereinafter, referred to as 'first correction lookup table') provided through a previous experiment may be used. In the present exemplary embodiment, it is assumed that a difference between the target current and the detected charging current is caused due to the resistance variation of the charging roller 23 according to its lifespan. Accordingly, in the present exemplary embodiment, an experiment is performed to correct the charging voltage in such a case where the difference between the target current and the detected charging current varies within a predetermined range. The surface electric potential of the organic photosensitive body 21 is measured as the applied charging voltage is changed, and a degree of changing the applied charging voltage, that is, the correction value, is obtained if the measured surface electric potential reaches a predetermined target electric potential. The experiment according to the present exemplary embodiment is performed by varying the target electric potential for each environment.

Table 3 represents the first correction lookup table according to an exemplary embodiment of the present general inventive concept.

TABLE 3

| target ADC − check ADC | | correction value | | | | | |
|---|---|---|---|---|---|---|---|
| | | | | LN 1, 2, 3 and | | | |
| min | max | NN and NH | | LL | | HH 1 and HH 2 | |
| | −20~ | 0 | | 0 | | 0 | |
| −18 | −20 | 0 | | 0 | | 0 | |
| −16 | −18 | 0 | | 0 | | 0 | |
| −14 | −16 | 0 | | 0 | | 0 | |
| −12 | −14 | 0 | | 0 | | 0 | |
| −10 | −12 | 0 | | 0 | | 0 | |
| −8 | −10 | 0 | | 0 | | 0 | |
| −6 | −8 | 0 | | 0 | | 0 | |
| −4 | −6 | 0 | | 0 | | 0 | |
| −2 | −4 | 0 | | 0 | | 0 | |
| 0 | −2 | 0 | | 0 | | 0 | |
| 0 | 2 | 1 | 2 V | 2 | 4 V | 0 | V |
| 2 | 4 | 5 | 10 V | 6 | 12 V | 0 | V |
| 4 | 6 | 9 | 18 V | 11 | 21 V | 6 | 12 V |
| 6 | 8 | 13 | 26 V | 15 | 30 V | 8 | 16 V |
| 8 | 10 | 17 | 34 V | 20 | 39 V | 10 | 20 V |
| 10 | 12 | 21 | 42 V | 24 | 48 V | 12 | 24 V |
| 12 | 14 | 25 | 50 V | 29 | 57 V | 14 | 28 V |
| 14 | 16 | 29 | 58 V | 33 | 66 V | 16 | 32 V |
| 16 | 18 | 33 | 66 V | 38 | 75 V | 18 | 36 V |
| 18 | 20 | 37 | 74 V | 42 | 84 V | 20 | 40 V |
| | 20~ | 37 | 74 V V | 42 | 84 V V | 20 | 40 V V |

In Table 3, the 'target ADC−check ADC' represents the difference between the target current and the detected charging current, the 'min' represents the minimum value thereof, and the 'max' represents the maximum value thereof. The 'correction value' represents a correction value of the charging voltage necessary to obtain the target electric potential for each case. NN, NH, LN 1, 2 and 3, LL and HH 1 and 2 represent various environments of temperature and humidity. The correction value, as illustrated in Table 2, may be expressed in terms of voltage.

As illustrated in Table 3, the correction value of the charging voltage increases as the difference between the target current and the detected charging current increases. This means that an effect of the resistance variation of the charging roller 23 increases as the difference between the target current and the detected charging current increases. Also, as illustrated in Table 3, the correction value is greater than "0" if the detected charging current is smaller than the target current. This means that the resistance of the charging roller 23 increases as time elapses. Also, as illustrated in Table 3, if the difference between the target current and the detected charging current is equal to or greater than 20, the correction value is restricted to the value associated with the difference between the target current and the detected charging current being equal to 20 (preventing an over voltage application by an excessive correction). In other words, in the present exemplary embodiment, the maximum correction value is determined when the difference between the target current and the detected charging current is equal to 20. Therefore, as illustrated in Table 3, the maximum correction value for the NN and NH environments is 74V, for the LN 1, 2, 3 and LL environments is 84V, and for the HH1 and HH2 environments is 40V.

In operation S402, the control unit 103 may determine the correction value of the charging voltage corresponding to the difference between the target current determined by the number of printed printing media, and the charging current detected in operation S401 by referring to the target current lookup table (referring to Table 2) and the first correction lookup table (referring to Table 3).

Then, the control unit 103 controls the voltage supplying unit 101 to apply the charging voltage corrected by the correction value as determined in the operation S402 (operation S403).

Accordingly, with respect to the charging voltage determined based on the system load, the correction is additionally performed based on the resistance variation of the charging roller 23 depending on the lifespan of the charging roller 23, thereby further improving the reliability of the charging voltage control.

In an exemplary embodiment of the present general inventive concept, another factor that may have an effect on the resistance variation of the charging roller 23, in addition to the time elapse, is taken into consideration. For example, a resistance variation of the charging roller 23 based on a variation of an applied charging voltage is taken into consideration.

Figure 8:
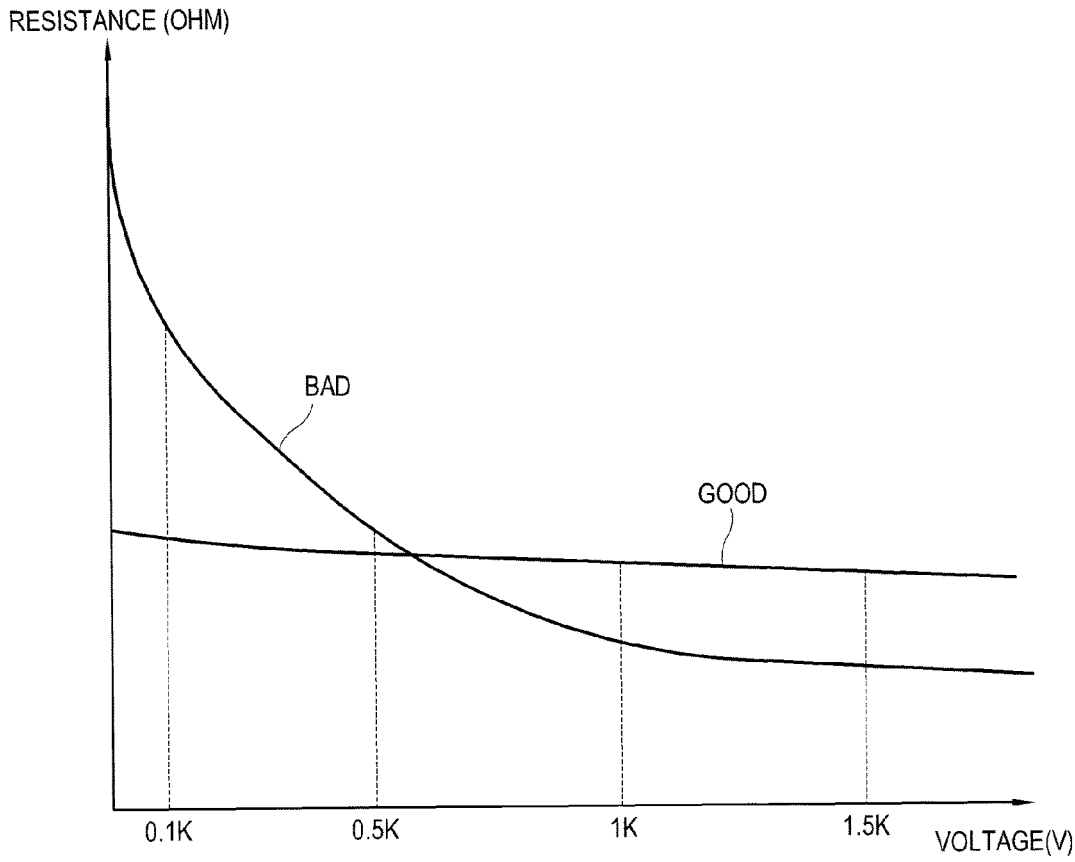
FIG. 8 illustrates a resistance variation of a charging roller depending on variation of a charging voltage according to an exemplary embodiment of the present general inventive concept.

FIG. 8 illustrates a resistance variation of the charging roller 23 based on a variation of the charging voltage according to an exemplary embodiment of the present general inventive concept. In FIG. 8, the horizontal axis represents the charging voltage, and the vertical axis represents the resistance of the charging roller 23. As illustrated by the "good" curve in FIG. 8, if the charging roller 23 is of "good quality," there is little or no variation of the resistance of the charging roller 23 based on the variation of the applied charging voltage. On the other hand, if the charging roller 23 is of "bad quality, as illustrated by the "bad" curve in FIG. 8, the resistance of the charging roller 23 rapidly decreases as the applied charging voltage increases. In this case, the decrease in the resistance of the charging roller 23 causes an increase of the charging current and the surface electric potential of the organic photosensitive body 21.

In an exemplary embodiment of the present general inventive concept, it is determined whether the charging roller 23 is of "good quality" or "bad quality," and the charging voltage is additionally corrected based on a resistance variation of the charging roller 23 if the charging roller 23 is of "bad quality."

Figure 9:
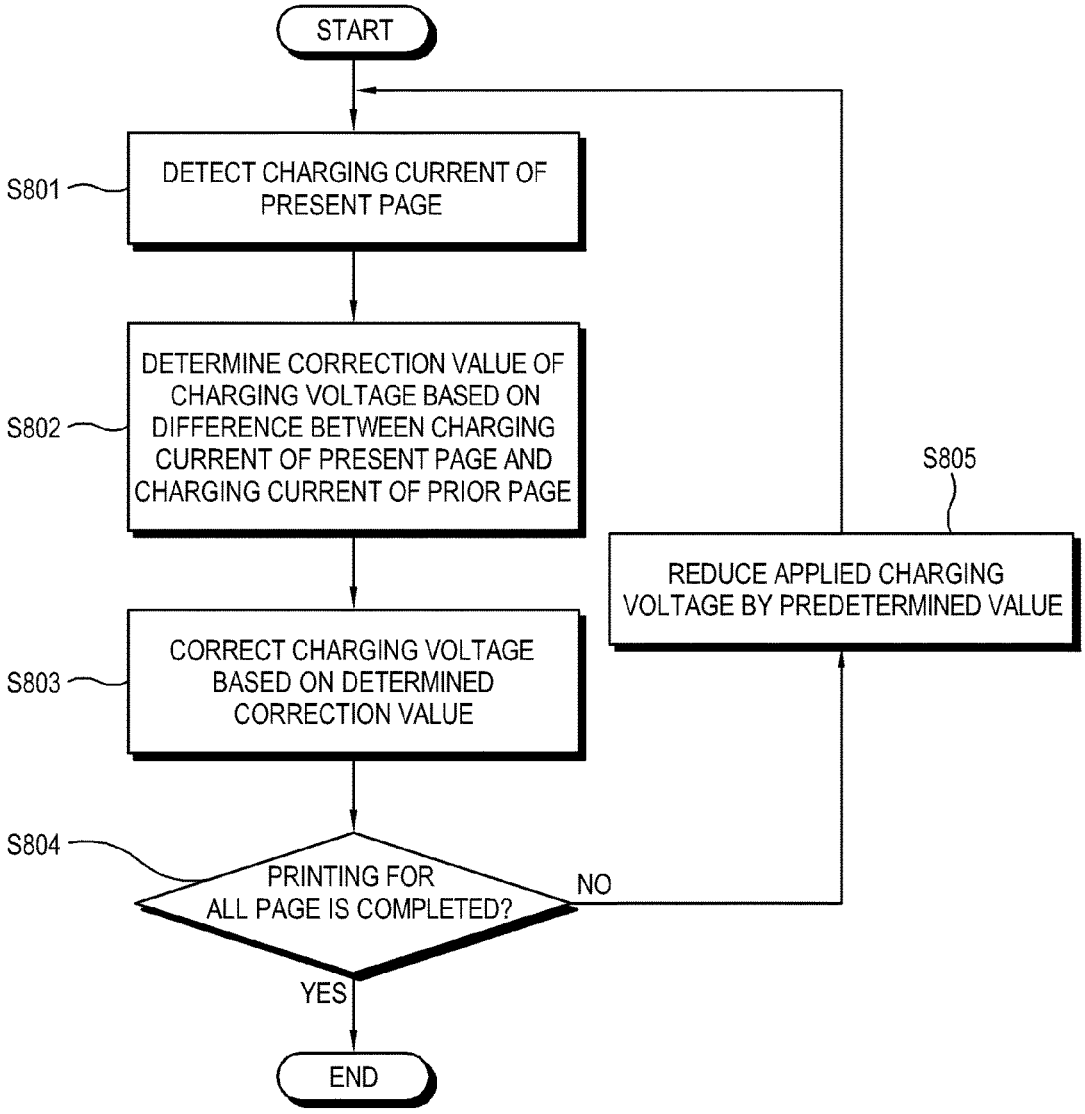
FIG. 9 illustrates a correcting process of a charging voltage with a consideration of a resistance variation of a charging roller depending on a variation of a charging voltage according to an exemplary embodiment of the present general inventive concept.

FIG. 9 illustrates a correcting process (hereinafter, referred to as 'second correction') of the charging voltage based the resistance variation of the charging roller 23 depending on the variation of the charging voltage according to an exemplary embodiment of the present general inventive concept. In the present exemplary embodiment, it is assumed that a plurality of pages are to be printed.

The control unit 103 obtains the charging current with respect to a present page among the plurality of pages by using the current detecting unit 102 (operation S801). The charging current detecting process in operation S801 may be performed sequentially from the first page of the plurality of pages to the last page of the plurality of pages.

The control unit 103 then determines a correction value of the charging voltage based on difference between the charging current of the present page and the charging current of a prior page (operation S802). In operation S802, with regard to the charging current of the prior page, a charging current obtained when printing a page just prior to the present page may be used. In operation S802, if the present page is the first page, since there is no charging current of the prior page, the determining of the correction value is omitted, and the correction value may be determined after the first page, such as when the present page is the second page.

In operation S802, in determining the correction value of the charging voltage to be applied, a lookup table (hereinafter, referred to as 'second correction lookup table') that has been previously provided may be used. In an exemplary embodiment of the present general inventive concept, it is assumed that a difference between the charging current of the prior page and the charging current of the present page is caused due to a rapid resistance variation due to deterioration of the quality of the charging roller 23. Accordingly, in the present exemplary embodiment, an experiment is performed to correct the charging voltage when the difference between the charging current of the prior page and the charging current of the present page has various values within a predetermined range. In each case, the surface electric potential of the organic photosensitive body 21 is measured as the applied charging voltage is changed, and a degree of changing the applied charging voltage, that is, the correction value, is obtained if the measured surface electric potential reaches a predetermined target electric potential. In the experiment according to the present exemplary embodiment, the experiment is performed by varying the target electric potential for each environment. Table 4 represents the second correction lookup table according to an exemplary embodiment of the present general inventive concept.

TABLE 4

| prepage ADC − check ADC | | correction value | | |
|---|---|---|---|---|
| | | LN 1, 2, 3 | | |
| min | max | NN and NH | and LL | HH 1 and HH 2 |
| | −20~ | 0 | 0 | 0 |
| −18 | −20 | 0 | 0 | 0 |
| −16 | −18 | 0 | 0 | 0 |
| −14 | −16 | 0 | 0 | 0 |
| −12 | −14 | 0 | 0 | 0 |
| −10 | −12 | 0 | 0 | 0 |
| −8 | −10 | 0 | 0 | 0 |
| −6 | −8 | 0 | 0 | 0 |
| −4 | −6 | 0 | 0 | 0 |
| −2 | −4 | 0 | 0 | 0 |
| 0 | −2 | 0 | 0 | 0 |
| 0 | 2 | 3 | 3 | 3 |
| 2 | 4 | 5 | 5 | 5 |

TABLE 4-continued

| prepage ADC – check ADC | | correction value | | |
|---|---|---|---|---|
| | | LN 1, 2, 3 | | |
| min | max | NN and NH | and LL | HH 1 and HH 2 |
| 4 | 6 | 8 | 8 | 8 |
| 6 | 8 | 10 | 10 | 10 |
| 8 | 10 | 13 | 13 | 13 |
| | 12~ | 13 | 13 | 13 |

In Table 4, the 'prepage ADC—check ADC' represents the difference between the charging current of the prior page and the charging current of the present page, the 'min' represents the minimum value thereof, and the 'max' represents the maximum value thereof. The 'correction value' represents a correction value of the charging voltage necessary to obtain the target electric potential by each case. NN, NH, LN 1, 2 and 3, LL and HH 1 and 2 represent various environments of temperature and humidity. The correction value, as illustrated in Table 2, may be expressed in terms of voltage.

As illustrated in Table 4, the correction value of the charging voltage increases as the difference between the charging current of the prior page and the charging current of the present page increases. This means that an effect of the resistance variation due to quality deterioration of the charging roller 23 increases as the difference between the charging current of the prior page and the charging current of the present page increases. Also, as illustrated in Table 4, the correction value is greater than "0" if the charging current of the present page is smaller than the charging current of the prior page. Also, as illustrated in Table 4, if the difference between the charging current of the prior page and the charging current of the present page is equal to or greater than 12, the correction value is restricted to the value associated with the difference between the charging current of the prior page and that of the present page being equal to 12 (preventing an over voltage application by an excessive correction). In other words, in the present exemplary embodiment, the maximum correction value is determined when the difference between the charging current of the prior and the charging current of the present page is equal to 20. Therefore, as illustrated in Table 4, the maximum correction value for the NN, NH, LN 1, 2, 3, LL, HH1, and HH2 environments is 13V.

The control unit 103 may determine the correction value of the charging voltage corresponding to the difference between the charging current of the prior page and the charging current of the present page obtained in the operation S801, by referring to the second correction lookup table.

Then, the control unit 103 controls the voltage supplying unit 101 to apply the charging voltage corrected by the correction value determined in the operation S802 (operation S803). The control unit 103 then determines whether all pages have been printed or not (operation S804). If the printing is not completed, the control unit 103 decreases the charging voltage to be applied by a predetermined value, and returns to the operation S801 to continue the correction for the next page (operation S805). In the operation S805, the charging voltage for the next page may be determined by the following Equation 4.

$$\text{charging voltage of next page} = \text{charging voltage of present page} \times 0.98 \qquad \text{Equation 4}$$

It is difficult to obtain the resistance variation of the charging roller 23 if the present page has the same charging voltage as the prior page and the resistance variation is generated based on the variation of the applied charging voltage if there the charging roller 23 is of "bad quality".

In Equation 4, the factor 0.98 is an example, and as such is not limited thereto. The factor may be determined based on a range of voltage capable of being appropriately applied depending on the system load of the image forming apparatus 1. The factor of Expression 4 may be less than 1 to prevent damage of the organic photosensitive body 21 due to diffusion of the charging voltage.

In the determining the result of operation S804, if the all pages have been printed and the printing process is completed, the second correction process is ended.

The correction is additionally performed based on the resistance variation of the charging roller 23 depending on the variation of the charging roller and its lifespan, thereby further improving reliability of the charging voltage control.

In the present general inventive concept, the first correction and the second correction may be performed together, or may be separately performed.

As described above, according to the present general inventive concept, in controlling a charging voltage by using a lookup table, the charging voltage is corrected with a more intensive consideration of a resistance variation of a charging roller, thereby uniformly maintaining a surface electric potential of an organic photosensitive body with further improved reliability.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A charging voltage control method of an image forming apparatus, comprising:

applying a charging voltage amount determined by referring to a basic lookup table which determines the charging voltage based on a system load and an operating environment;

correcting the applied charging voltage by using a first correction value which is determined based on a first correction lookup table which determines the first correction value using a difference between a target current corresponding to the lifespan of the charging roller and a charging current; and selecting a value of the first correction lookup table corresponding to the calculated difference and the operating environment, wherein the basic lookup table is provided based on a degree of variation of a surface electric potential of an organic photosensitive body due to a variation of the system load.

2. The method of t claim 1, wherein the correcting is performed for each page when printing a plurality of pages.

3. The method of claim 2, further comprising:

additionally correcting the applied charging voltage by using a second correction value which is determined based on a second correction lookup table.

4. The method of claim 3, wherein the additionally correcting operation is performed if a charging current of a present page of the plurality of pages is smaller than a charging current of a prior page.

5. The method of claim 3, wherein in the additionally correcting operation the charging voltage of a present page is smaller than the charging voltage of a prior voltage.

6. The method of claim 3, wherein at least one of the first correction value and the second correction value is restricted to be less than or equal to a predetermined limit value.

7. The method of claim 3, wherein at least one of the first correction value and the second correction value is provided to correspond to temperature and/or humidity.

8. An image forming apparatus, comprising:

an image carrying body on which a latent image is formed;

a charging roller which charges a surface of the image carrying body to form the latent image;

a voltage supplying unit which applies a charging voltage to charge the surface of the image carrying body to the charging roller; and a control unit which controls the voltage supplying unit to apply the charging voltage of an amount determined by referring to a basic lookup table which determines the charging voltage based on a system load and an operating environment, and to correct the applied charging voltage by using a first correction value which is determined based on a first correction lookup table which determines the first correction value using the operating environment and a difference between a target current corresponding to a lifespan of the charging roller and a charging current, wherein the basic lookup table is provided based on a degree of variation of a surface electric potential of an organic photosensitive body due to a variation of the system load.

9. The image forming apparatus of claim 8, wherein the control unit corrects the applied charging voltage for each page when printing a plurality of pages.

10. The image forming apparatus of claim 9, wherein the control unit controls the voltage supplying unit to additionally correct the applied charging voltage by using a second correction value which is determined based on a second correction lookup table.

11. The image forming apparatus of claim 10, wherein the control unit additionally corrects the applied charging voltage if a charging current of a present page of the plurality of pages is smaller than a charging current of a prior page.

12. The image forming apparatus of claim 10, wherein the charging voltage of a present page is smaller than the charging voltage of a prior voltage.

13. The image forming apparatus of claim 10, wherein the first correction value and/or the second correction value is restricted to be less than or equal to a predetermined limit value.

14. The image forming apparatus of claim 10, wherein the first correction value and/or the second correction value is provided to correspond to at least one of temperature and humidity.

15. A method of controlling a charging voltage of a charging roller of an image forming apparatus, the method comprising:

applying a charging voltage to the charging roller corresponding to a system load and an operating environment;

selecting a correction value from at least, one correction lookup table corresponding to the operating environment and a calculated difference between a target current and a detected charging current;

generating a corrected charging voltage using the applied charging voltage and the correction value from the at least one correction lookup table, the correction value corresponding to the applied charging voltage; and applying the corrected charging voltage to the charging roller, wherein a basic lookup table is provided based on a degree of variation of a surface electric potential of an organic photosensitive body due to a variation of the system load.

16. The method of claim 15, wherein the generating of a corrected charging voltage comprises:

detecting a charging current based on the charging voltage;

obtaining a first value from a first correction lookup table based on the detected charging current;

obtaining a second value from a second correction lookup table based on the detected charging current; and increasing the applied charging voltage by the correction value which is a sum of the first value and the second value.

17. A method of controlling a charging voltage of a charging roller of an image forming apparatus, the method comprising:

applying a charging voltage to the charging roller corresponding to a system load and an operating environment;

generating a corrected charging voltage using the applied charging voltage and a correction value from at least one correction lookup table, the correction value corresponding to the applied charging voltage; and applying the corrected charging voltage to the charging roller, wherein the generating of a corrected charging voltage comprises:

detecting a charging current based on the charging voltage;

obtaining a first value from a first correction lookup table based on the detected charging current;

obtaining a second value from a second correction lookup table based on the detected charging current; and increasing the applied charging voltage by the correction value which is a sum of the first value and the second value, and wherein the obtaining a first value comprises:

calculating a difference between a target current and the detected charging current, where the target current is based on a remaining lifespan of the charging roller; and selecting a value of the first correction lookup table corresponding to the calculated difference and the operating environment.

18. The method of claim 17, wherein the operating environment is selected from a group consisting of: high temperature/high humidity, high temperature/normal humidity, high temperature/low humidity, normal temperature/high humidity, normal temperature/normal humidity, normal temperature/low humidity, low temperature/high humidity, low temperature/normal humidity, and low temperature/low humidity.

19. A method of controlling a charging voltage of a charging roller of an image forming apparatus, the method comprising:

applying a charging voltage to the charging roller corresponding to a system load and an operating environment;

generating a corrected charging voltage using the applied charging voltage and a correction value from at least one correction lookup table, the correction value corresponding to the applied charging voltage; and applying the corrected charging voltage to the charging roller, wherein the generating of a corrected charging voltage comprises:

detecting a charging current based on the charging voltage;

obtaining a first value from a first correction lookup table based on the detected charging current;

obtaining a second value from a second correction lookup table based on the detected charging current; and increasing the applied charging voltage by the correction value which is a sum of the first value and the second value, and wherein the obtaining a second value comprises:

calculating a difference between a charging current of a prior page with a charging current of a present page; and selecting a value of the second correction lookup table corresponding to the calculated difference and the operating environment.

20. An image forming apparatus including a photosensitive medium on which to form an image, the image forming apparatus comprising:

a charging roller to charge a surface of the photosensitive medium;

a voltage supplying unit to apply a charging voltage to the charging roller corresponding to a system load and an operating environment; and a control unit to generate a corrected charging voltage using the applied charging voltage and a correction value selected from at least one correction lookup table that corresponds to the operating environment and a calculated difference between a target current and a detected charging current, and to control the voltage supplying unit to apply the corrected charging voltage to the charging roller, wherein a basic lookup table is provided based on a degree of variation of a surface electric potential of an organic photosensitive body due to a variation of the system load.

21. The image forming apparatus of claim 20, further comprising:

a current detector to detect a current of the charging voltage and to transmit the detected current to the control unit, wherein the control unit generates the corrected charging voltage based on the detected current of the charging voltage.

22. The image forming apparatus of claim 20, wherein the at least one correction lookup table comprises:

a first correction table which includes a plurality of correction values based on a difference between a target current corresponding to a lifespan of the charging roller and a charging current based on the applied charging voltage; and a second correction table which includes a plurality of correction values based on a difference between a charging current corresponding to a prior image and a charging current corresponding to a present image.

* * * * *